US006666227B2

(12) United States Patent
Erickson

(10) Patent No.: US 6,666,227 B2
(45) Date of Patent: Dec. 23, 2003

(54) ADJUSTABLE VALVE ASSEMBLY

(75) Inventor: Perry D. Erickson, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 140 days.

(21) Appl. No.: 10/051,499

(22) Filed: Jan. 18, 2002

(65) Prior Publication Data

US 2003/0136934 A1 Jul. 24, 2003

(51) Int. Cl.[7] ..... F16K 31/00; F16L 5/00
(52) U.S. Cl. ..... 137/270; 137/359; 251/293
(58) Field of Search ..... 251/293, 292; 137/359, 360, 270, 269

(56) References Cited

U.S. PATENT DOCUMENTS 3,582,116 A 6/1971 Young
4,336,427 A * 6/1982 Lindsay ..... 137/360
4,445,529 A 5/1984 Lagarelli
4,662,389 A 5/1987 Igbal
4,794,945 A * 1/1989 Reback ..... 251/291
4,842,009 A 6/1989 Reback
5,183,069 A * 2/1993 Berg et al. ..... 251/266
5,257,645 A 11/1993 Scully et al.
5,467,799 A 11/1995 Buccicone et al.
5,947,149 A 9/1999 Mark
6,178,981 B1 * 1/2001 Wales ..... 251/293

* cited by examiner

*Primary Examiner*—John Bastianelli
(74) *Attorney, Agent, or Firm*—Quarles & Brady LLP

(57) ABSTRACT

A tub/shower valve assembly includes a three-position valve stem adapter for varying the depth dimension of the assembly. The stem adapter has a splined bore with stop members located at a position skewed towards one end of the stem adapter. The stem adapter can thus be pushed onto the valve stem different distances depending on which is the leading end. The stem adapter can be disposed onto the valve stem a further distance by pushing the stop members past the end of the valve stem, allowed by outward expansion of the sides of the stem adapter.

12 Claims, 8 Drawing Sheets

10
20
22
3
3
32
34
18
26
16
14
30
24
12
25

10
20
22
5
5
32
34
38
16
18
26
14
30
24
12

10
20
22
34
32
18
26
38
7
16
7
19
30
24
12

ADJUSTABLE VALVE ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to plumbing valves, and in particular to adjustable mounting systems for use therewith.

Tub/shower faucets are typically mounted through a wall surrounding the tub or the shower stall. They are anchored against rear studs and/or to the wall board, and linked to the water supply from behind the wall, and they have a valve stem that projects forward adjacent a wall opening to provide control over the valve from the room side of the wall.

Most of these valves are mixer valves which accept both hot and cold water, control the proportioning and volume of water there through, and deliver a mixed outlet stream to a tub filler, shower head and/or the like when the valve is activated. See e.g. U.S. Pat. No. 5,467,799. Other such valves merely control the volume of a single supply of cold or hot water.

Such valves are typically designed so that a valve stem protrudes into the room through a hole in the room wall, with a surrounding decorative escutcheon that effectively hides the wall hole. The escutcheon also prevents leakage through the wall hole and restricts heat/cold transfer between opposite sides of the wall.

Since the thickness of the wall will vary depending on the construction material selected by the builder or customer, the plumbing installer often first makes a rough-in installation, and then corrects for the final materials. The final adjustment is often achieved by providing threads on the valve housing which the escutcheon can tighten down on, thus providing some range of adjustment. See e.g. U.S. Pat. No. 5,947,149.

However, where the wall is particularly thin or unusually thick the amount of adjustment allowed by such threads may be insufficient, thereby requiring the plumber to reposition the valve at a time when access to the valve is restricted. This can be time consuming and may damage construction that has already occurred.

Various mounting assemblies have been developed to try to address this problem. For example, U.S. Pat. No. 4,662,389 discloses a valve assembly with a valve extension that can be threaded to vary the position of the escutcheon. This assembly has the disadvantage of requiring many components and separate fasteners.

U.S. Pat. No. 4,842,009 discloses an assembly which is suitable to receive a variety of adapters. The length of the assembly can be varied by eliminating or adding extension pieces. This system requires multiple parts.

U.S. Pat. No. 4,445,529 provides a less complex assembly in which a plastic insert with internal splines is adjustably mounted along the length of the stem by a set screw. However, use of a set screw in this context can be awkward.

Thus, a need still exists for an improved adjustable valve assembly which can be mounted through room walls of widely varying thickness.

SUMMARY OF THE INVENTION

The invention provides a valve assembly with a three-position adapter for adjustably mounting a valve handle to a valve stem. In one aspect the invention provides a valve assembly having a rotatable valve stem for controlling fluid flow through the valve assembly, a stem adapter having first and second ends with openings suitable to alternately receive pre-defined different first and second lengths of the valve stem, and a handle linked to the valve stem via the stem adapter. By flip-flopping the adapter one can switch from a setting for a thin wall to a setting for a wall of intermediate thickness.

In preferred forms the stem adapter has an internal stop element located closer to the first end than to the second end, the stem is splined, and the stem adapter openings engage the stem splines to restrict relative rotation there between. The stem adapter openings can be part of a single axial opening through the stem adapter, and the stem adapter can be suitable to receive a third length of the valve stem which is different than the first and second lengths when the stop element has flexed in a radially outward direction.

In another aspect the stem adapter can have planar outer surfaces that slope radially inwardly towards the first and second ends from an intermediate location there between, and the outer surfaces can join at slotted corners. There can also be a stem driver mounted to the handle and defining a socket engaging outer surfaces of the stem adapter.

In yet another preferred form there can be a retainer mounted to the valve having a threaded end. A bonnet is mounted to the threaded end of the retainer to conceal the stem driver and the stem adapter such that the bonnet is rotatable with respect to the handle.

In another aspect the invention provides valve assembly where there is a rotatable valve stem for controlling fluid flow through the valve assembly. A stem adapter has an opening extending through opposite first and second ends and has a radial stop member positioned closer to the first end than the second end such that the opening alternatively is suitable to receive a first distance of the valve stem from the first end and a second distance of the valve stem (different from the first distance) from the second end. The opening can also receive a third distance of the valve stem when the radial stop has flexed radially outwardly. A handle is linked to the valve stem via the stem adapter.

Thus, an installer can adjust the assembly from the room side of the wall for a thin wall by having the valve stem be inserted into the end of the adapter which is closest to the stop. Alternatively, the adapter can be flipped to provide the ability for the valve stem to be inserted into an end of the adapter which is the farthest from the stop (resulting in an assembly suitable for a thicker wall). For extremely thin walls the adapter can be pushed hard onto the stem so as to cause the stop flex outwardly. This allows more of the valve stem to enter the adapter.

This assembly is comprised of few parts, is inexpensive to manufacture, and is easy to assembly without complex tools. Further, unlike set screws, the parts of the present invention are not so small that they are easily dropped or lost.

These and other advantages of the invention will be apparent from the detailed description and drawings.

DETAILED DESCRIPTION OF THE PREFERRED EMBODIMENT

Figure 1:
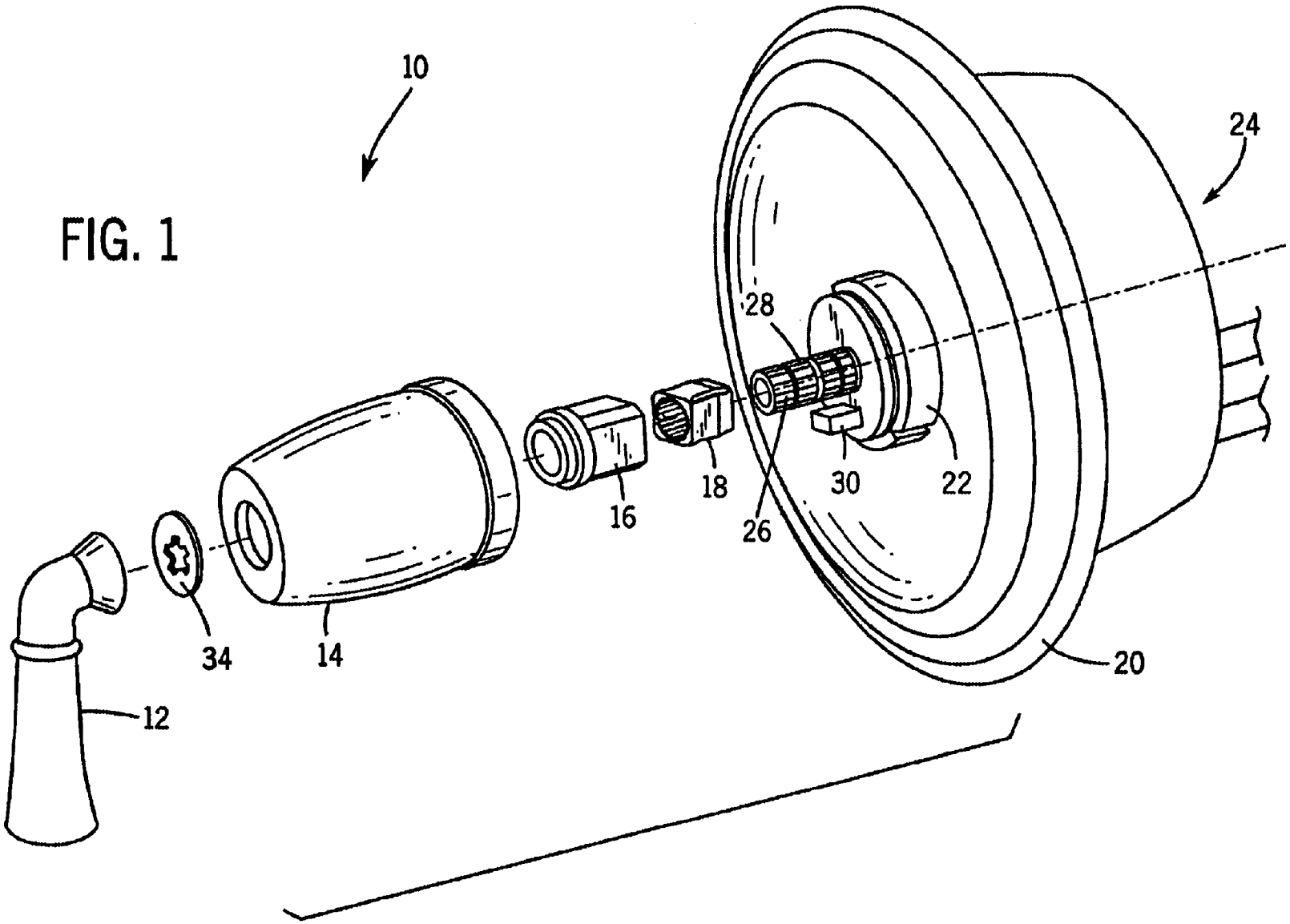
FIG. 1 is an exploded perspective view of an embodiment of the present invention.

Referring first to FIG. 1, a valve assembly 10 of the present invention includes a handle 12, a bonnet 14, a stem driver 16, an adapter 18, a decorative escutcheon 20, a retainer 22 and a valve unit 24. One possible valve unit to be used with this construction is that described in U.S. Pat. No. 5,467,799, the disclosure of which is hereby incorporated by reference as if fully set forth herein.

The handle 12 is used to rotate a valve stem 26 of the valve 24, and is coupled thereto via a coupling of the stem driver 16 to the handle (so that it rotates therewith), a coupling of the stem driver 16 with the adapter 18 (so that it rotates therewith), and a coupling of the adapter to the valve stem 26 (so that it rotates therewith). The bonnet 14 shrouds this connection and the escutcheon 20 conceals the hole through the wall through which valve 24 projects.

Figure 2:
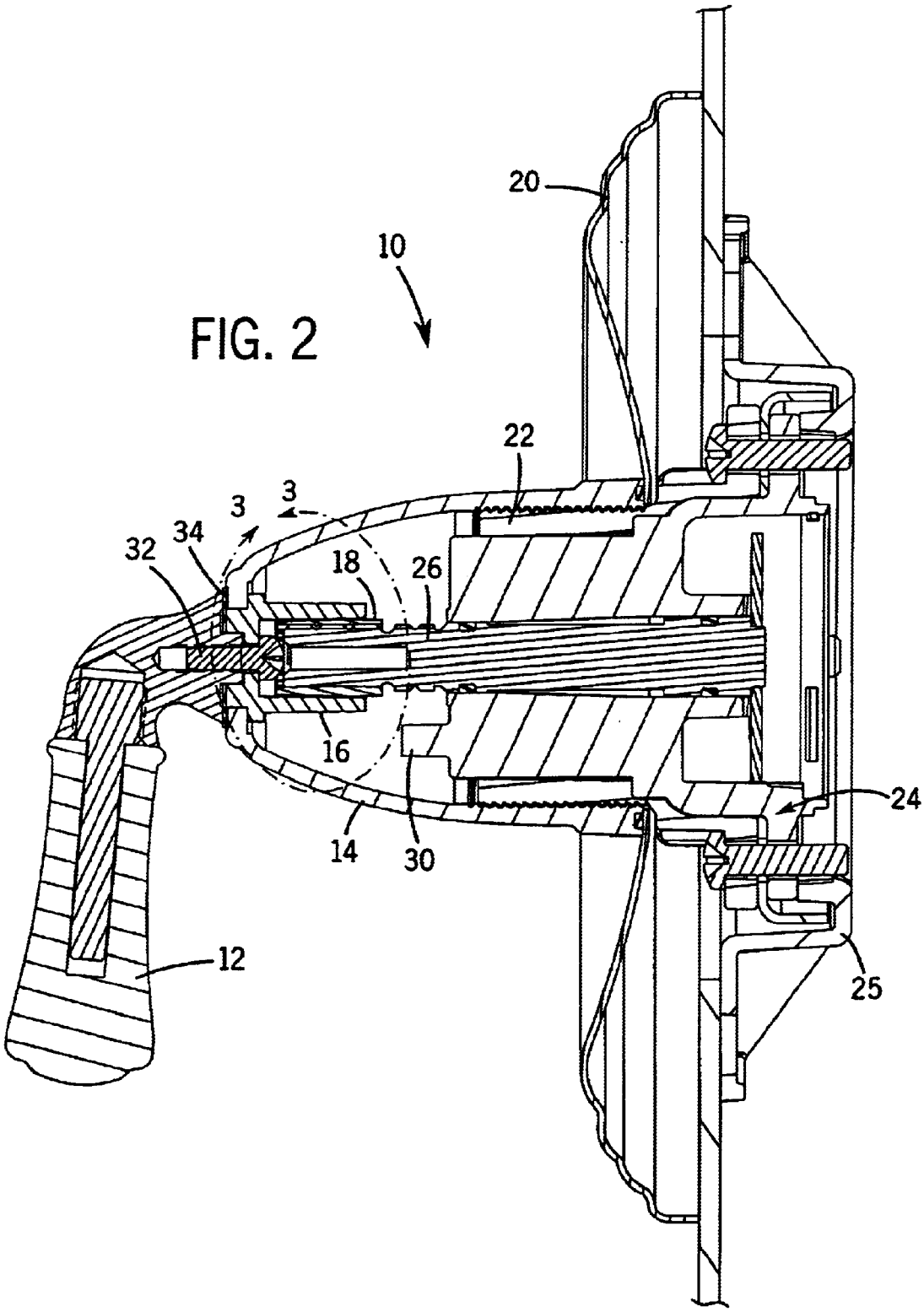
FIG. 2 is a cross-sectional view of the valve assembly of FIG. 1 (when assembled and mounted through a room wall), where an adapter element is fully pressed onto a valve stem.

As shown in FIG. 2, the valve 24 can include a separate valve cap 25 that bolts onto a valve body and also permits a mounting of the valve body to a rear of the room wall. The usual hot and cold water supply lines link to the valve.

Valve stem 26 adjusts the flow rate and temperature of the water through the valve 24 via at least rotational movement. As indicated in FIG. 1, the valve stem 26 has the usual axially extending splines 28 along its outer periphery.

The valve stem 26 also has a fixed rotational stop member 30 extending parallel with the valve stem 26. As is well known, such a member can cooperate with another member (not shown) that can be mounted on the valve stem to rotate therewith. This limits the arc of rotation of the valve stem 26 and thus provides a maximum hot temperature.

As seen in FIG. 2, the retainer 22 bolts to the valve cap 25 with the valve stem 26 extending towards the room. The retainer 22 has four notches that accommodate four ribs of the valve cap and help align the retainer 22. The escutcheon 20 fits onto and around the retainer 22. It is large enough to conceal the wall hole, as well as any attachments between the valve cap 25 and the wall. The escutcheon 20 has two tabs at its inner diameter that mate with cut outs in the retainer 22 to properly orient graphics and/or text on the escutcheon 20 (e.g. the word "hot", the word "cold" and an arrow there between to suggest a rotary direction).

The handle 12 fits over an opening in one end of the bonnet 14. The stem driver 16 is fixed to the handle 12 to rotate therewith by an axial bolt 32 extending outward through the opening in the bonnet 14. The stem driver 16 has a shoulder at an outer end that is larger than the opening in the bonnet 14 so that the bonnet 14 is captured between the handle 12 and the stem driver 16 while both can rotate relative to the bonnet.

Thus, once the bonnet 14 is threaded onto the retainer 22 at the inward end of the bonnet, it no longer rotates. A washer 34 can be inserted between the handle 12 and the bonnet 14 to ease rotation of the handle 12, if desired. Alternatively, a lubricant can be provided at this position, and/or the materials can be selected to permit sliding contact.

It should be noted that the stem driver 16 has a squared inward socket. This is suitable to axially slidably receive the outer walls of the adapter 18. The adapter 18 is not bolted onto the valve stem. Rather, its internal splines permit no relative rotation between the adapter 18 and valve stem 26, and the bonnet 14 (by virtue of being anchored to the retainer 22) holds the driver, and thus the adapter, axially in place on the stem.

Referring next to FIGS. 8–11, adapter 18 has sides with planar surfaces tapering to opposite ends from an offset intermediate location along its length. The tapered surfaces ease the insertion of the adapter 18 into the stem driver socket and ensure a tight grip at the radially outermost edges of all four sides. This reduces wobble so that the handle has a solid feel and ensures that there is no slip between the stem driver 16, the adapter 18 and the valve stem 26.

The corners (preferably all four, but alternatively 1, 2, or 3) of the adapter 18 have elongated slots or other cut out geometry 36 allowing for outward deflection of the sides if needed when mounting the adapter 18 onto the valve stem 26. The slots 36 also allow the sides to be compressed inwardly when pressed into the stem driver 16.

The adapter 18 has an internally splined cylindrical bore 38 there through for engaging the splines 28 of the valve stem 26. Small, radially inwardly projecting stop elements 40 are formed integrally with the adapter 18 in a circular pattern in valleys between the splines of the adapter 18, at an intermediate location approximately ⅓ of the way in from one end.

Figure 3:
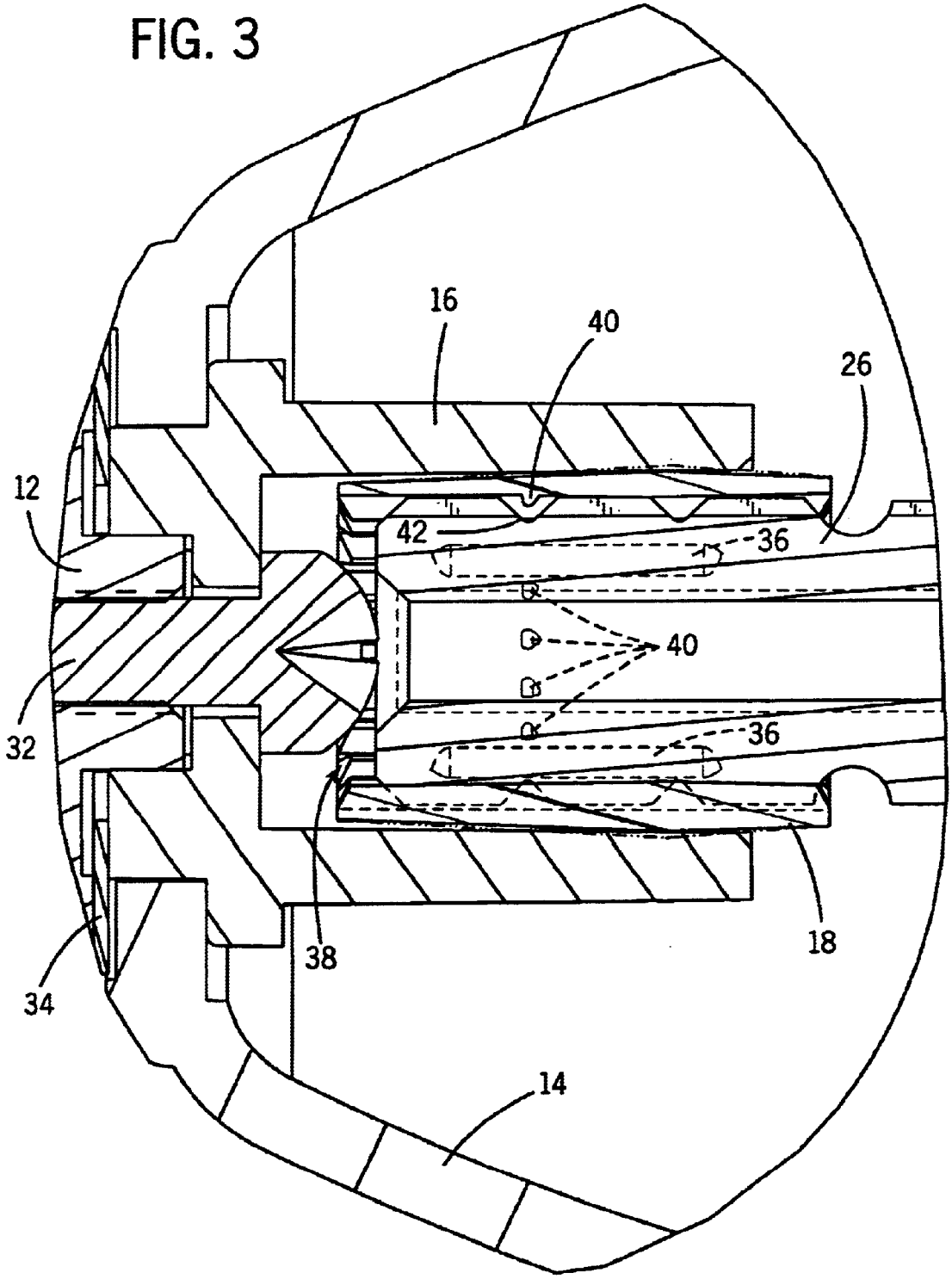
FIG. 3 is an enlarged view of a portion of the FIG. 2 drawing.

The adapter 18 can be mounted onto the valve stem 26 at any one of three pre-defined positions along its length, depending on the thickness of the wall in which the valve assembly is being installed. FIGS. 2–3 show the adapter 18 fully pressed onto the end of the valve stem 26. Note that the sides of the adapter 26 have flexed outward slightly to allow the stop elements 40 to pass over the splines of the valve stem 26. In this position, the stop elements 40 will be disposed in a circumferential groove 42 in the valve stem 26. This position accommodates the least thick room walls as bonnet 14 can thread farther onto the retainer 22.

Figure 4:
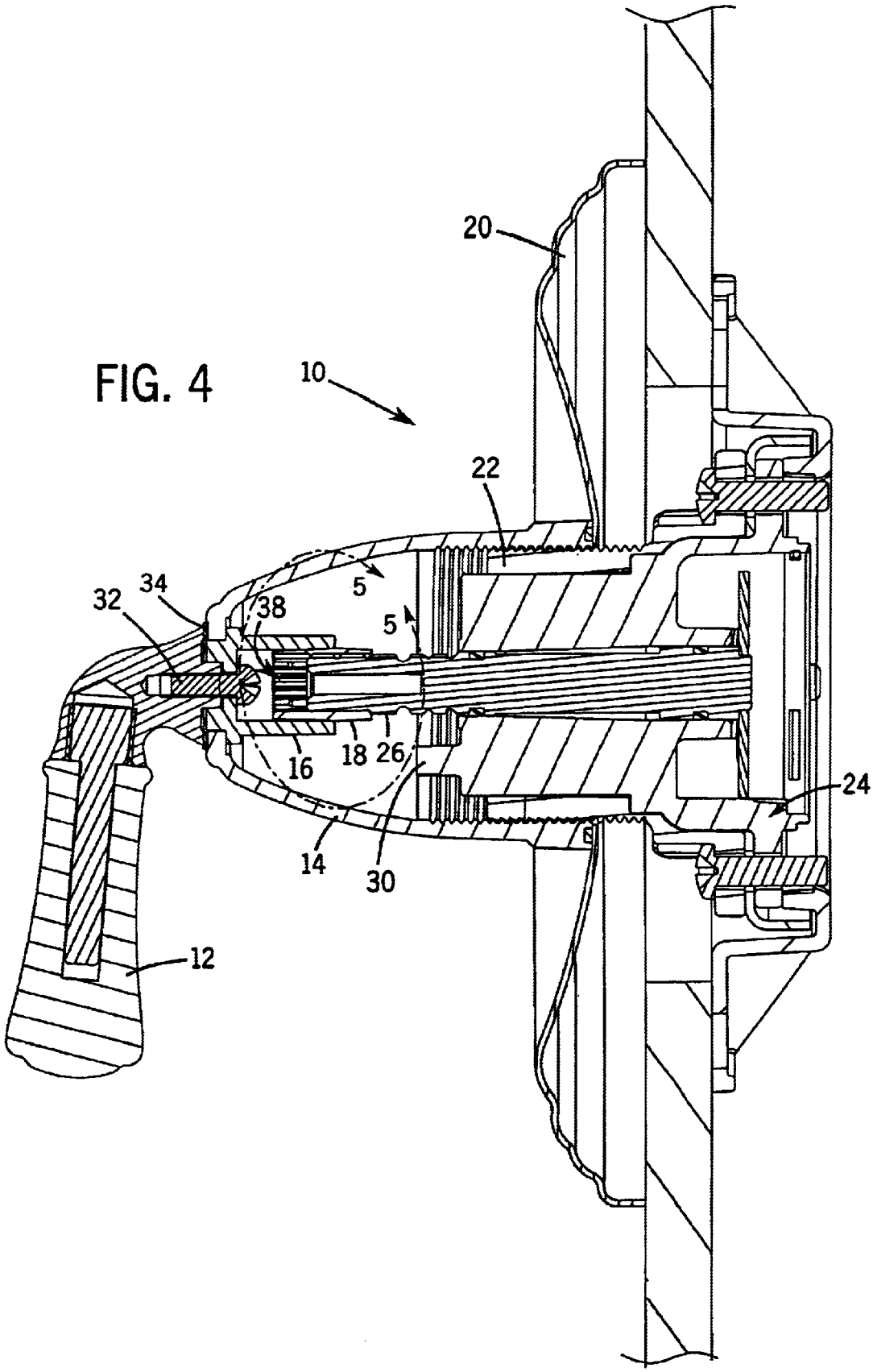
FIG. 4 is a view similar to FIG. 2, albeit with the adapter pressed onto the valve stem somewhat less than in FIG. 2, to accommodate a thicker wall.
Figure 5:
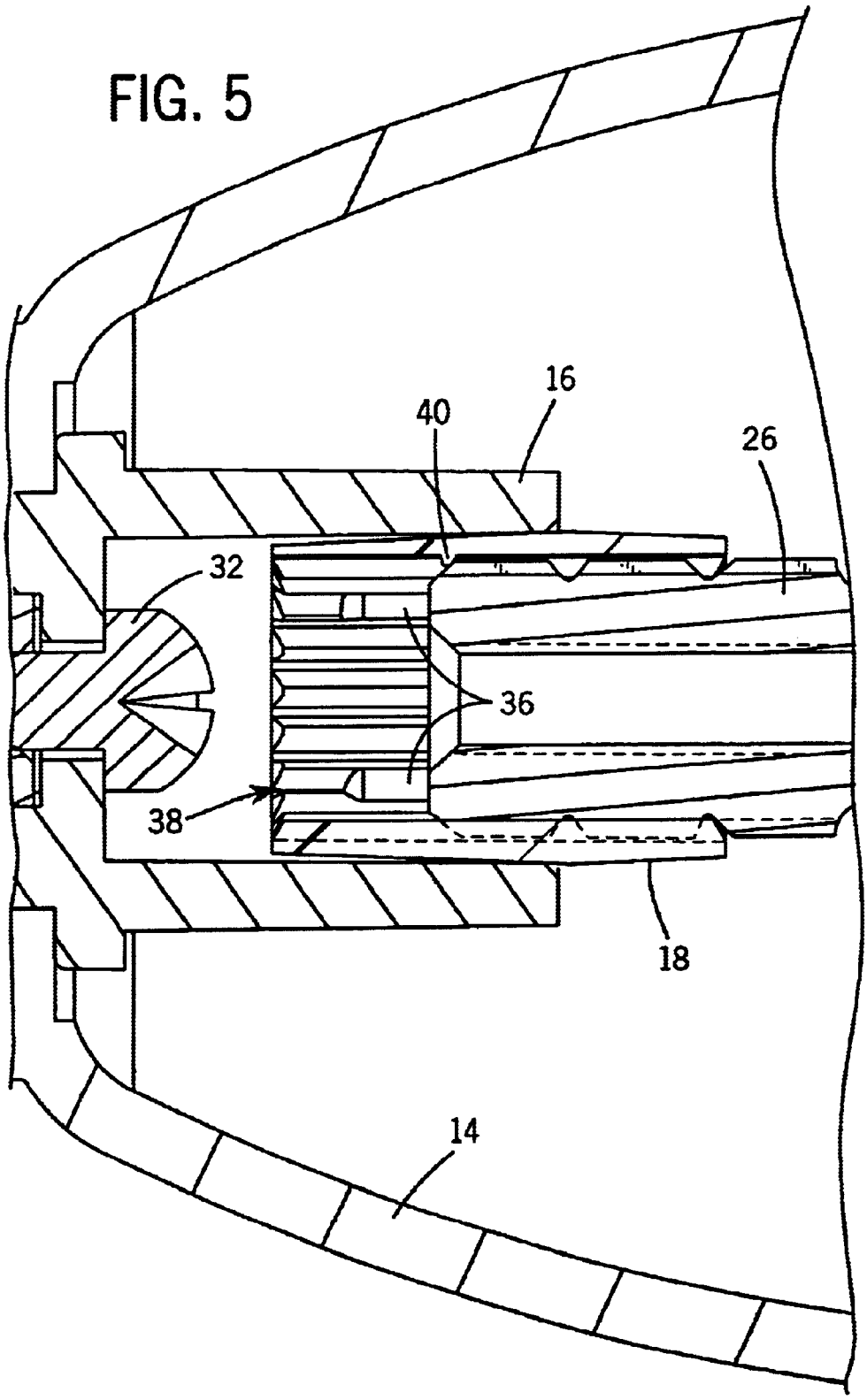
FIG. 5 is an enlarged view of a portion of the FIG. 4 drawing.

FIGS. 4–5 show the assembly as mounted to a wall of intermediate thickness. Here, the adapter 18 is pressed onto the valve stem 26 with the end farthest from the stop elements 40 first until they contact the end of the valve stem 26. Note that the adapter 18 remains "wedged" into the socket of the stem driver 16, providing a tight connection.

Figure 6:
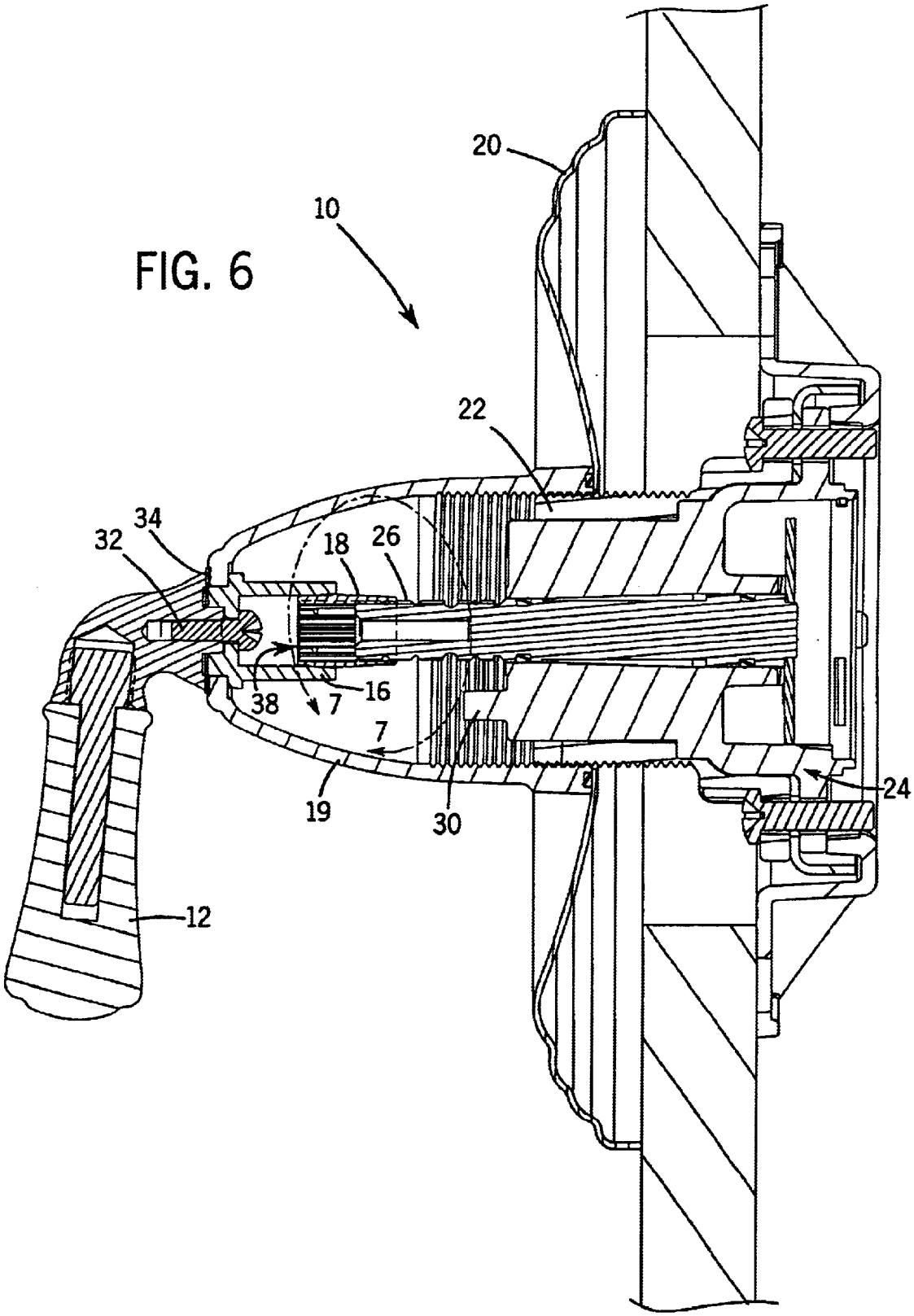
FIG. 6 is a view similar to FIG. 4, but with the adapter pressed onto the valve stem even less than as shown in FIG. 4, to accommodate a still thicker room wall.
Figure 7:
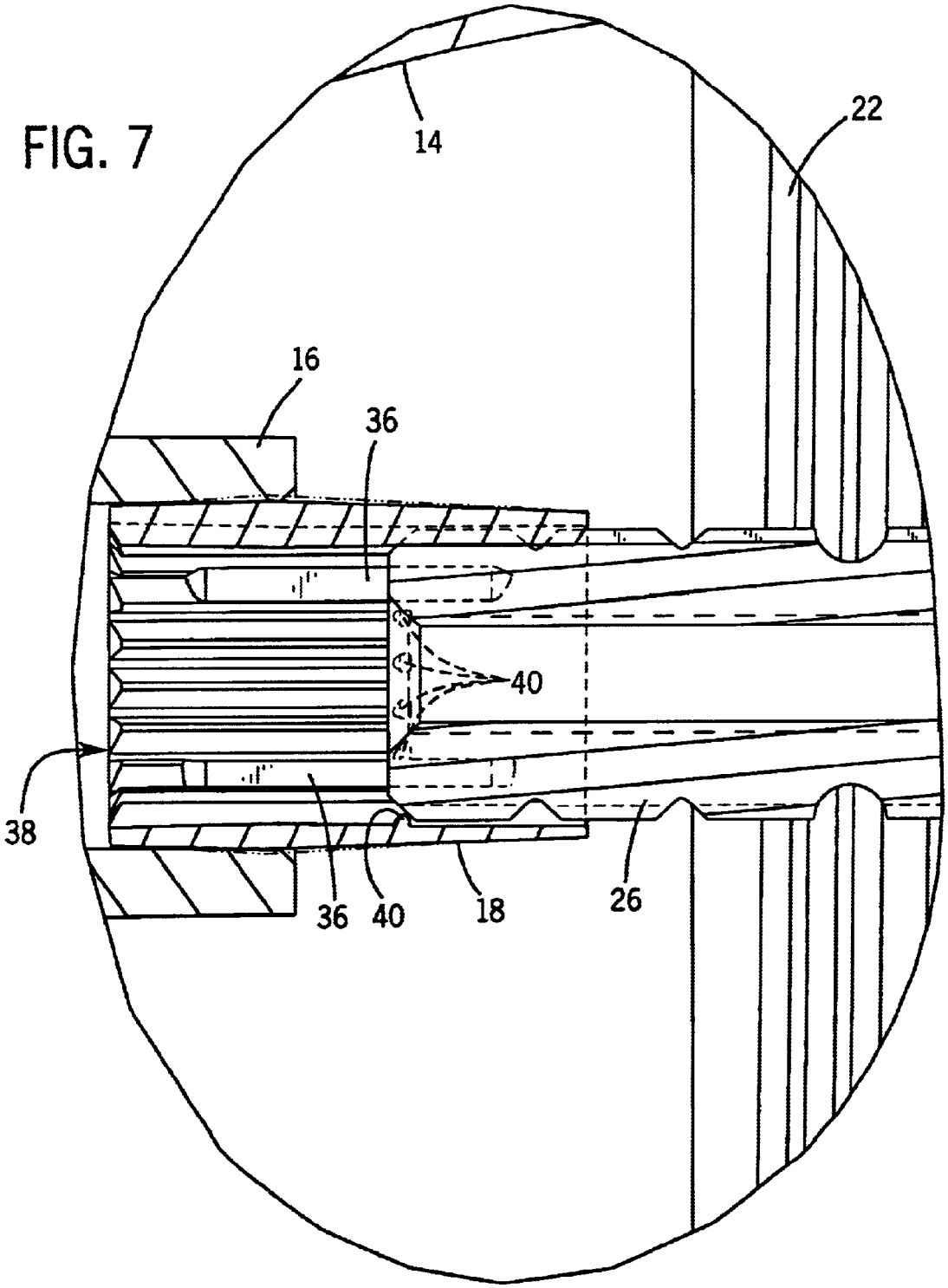
FIG. 7 is an enlarged view of a portion of the FIG. 6 drawing.
Figure 8:
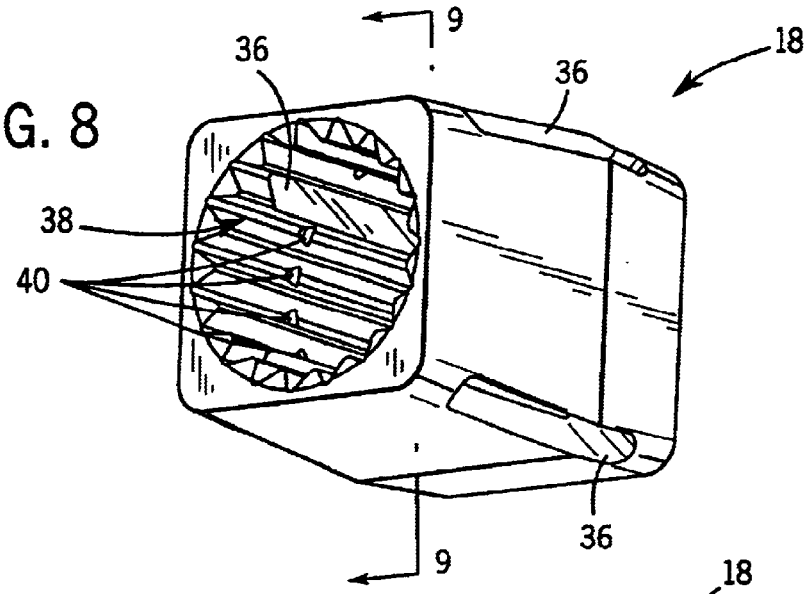
FIG. 8 is an enlarged perspective view of an adapter in accordance with the present invention.
Figure 9:
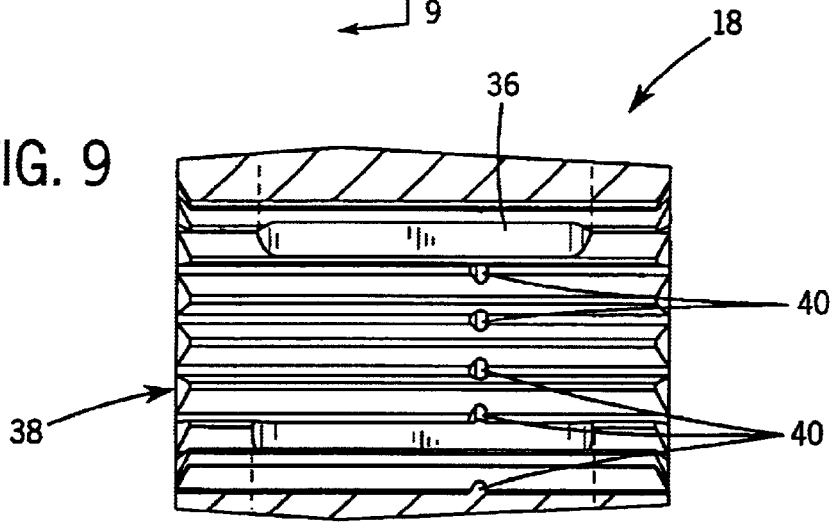
FIG. 9 is a cross-sectional view taken along line 9—9 of FIG. 8.
Figure 10:
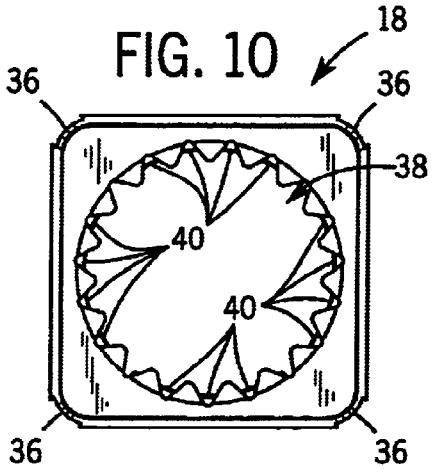
FIG. 10 is an top view of the adapter.
Figure 11:
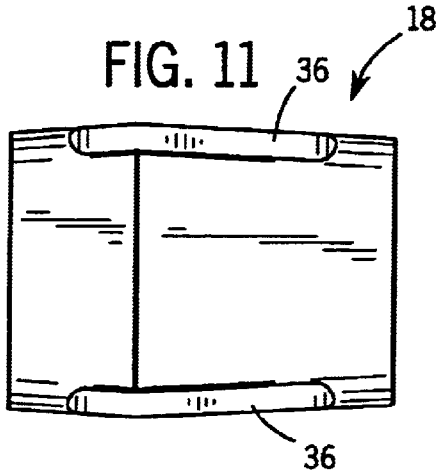
FIG. 11 is a side elevational view of the adapter.

FIGS. 6–7 show the assembly as mounted to a wall of even thicker construction, such as one that is wall board with tile mounted thereon (not shown). Here, the adapter 18 is pressed onto the valve stem 26 with the end nearest from the stop elements 40 first until they contact the end of the valve stem 26. Note again that the adapter 18 is still wedged into the socket of the stem driver 16.

Thus, there are three well defined mounting positions. In one, the stem is completely forced through most of the adapter because of the ability of the sides of the adapter to flex outwardly. Two other positions are defined by an offset stop in the cavity of the adapter, and the adapter can be flipped to change between them.

Thus, significant variability in room wall depth can be accommodated. Further, three specific defined starting positions are created. Of course, use of different size adapters could create even greater flexibility.

The stem driver 16, "flip-flop" adapter 18 and the retainer 22 can be made of Celcon®. The escutcheon 20 can be a stamped sheet metal, such as brass or stainless steel, and the handle 12 and the bonnet 14 can be chrome plated ABS plastic.

One can easily determine which adapter position is appropriate without trial and error. One can measure the distance from the end of the retainer 22 to a flat surface at the center of the escutcheon 20 while holding it firmly against the wall. This distance will indicate the proper adapter position to select.

The system can be assembled easily with minimal tools. Moreover, the assembly has no exposed fasteners, thus providing an aesthetically pleasing assembly.

A preferred embodiment of the invention has been described above. However, modifications and variations to the preferred embodiment will be apparent to those skilled in the art, which will be within the spirit and scope of the invention. For example, the assembly can be used to mount a faucet valve on a kitchen or lavatory sink top. Therefore, the invention should not be limited to just the described embodiment. To ascertain the full scope of the invention, the following claims should be referenced.

INDUSTRIAL APPLICABILITY

The invention provides an improved adjustable valve assembly for facilitating mounting of shower controls and the like on walls.

I claim:

1. A valve assembly, comprising:

a rotatable valve stem for controlling fluid flow through the valve assembly;

a stem adapter having first and second ends with openings suitable to alternately receive pre-defined different first and second lengths of the valve stem; and a handle linked to the valve stem via the stem adapter.

2. The valve assembly of claim 1, wherein the stem adapter has an internal stop element located closer to the first end than to the second end.

3. The valve assembly of claim 2, wherein the stem is splined and the stem adapter openings engage the stem splines to restrict relative rotation there between.

4. The valve assembly of claim 2, wherein the stem adapter openings are part of a single axial opening through the stem adapter.

5. The valve assembly of claim 4, wherein the stem adapter is suitable to receive a third length of the valve stem which is different than the first and second lengths when the stop element has flexed in a radially outward direction.

6. The valve assembly of claim 1, wherein the stem adapter has planar outer surfaces.

7. The valve assembly of claim 6, wherein the outer surfaces slope inwardly towards the first and second ends from an intermediate location there between.

8. The valve assembly of claim 7, wherein outer surfaces join at corner cutouts.

9. The valve assembly of claim 1, further including a stem driver mounted to the handle and defining a socket engaging outer surfaces of the stem adapter.

10. The valve assembly of claim 9, further including:

a retainer mounted to the valve and having a threaded end; and a bonnet mounted to the threaded end of the retainer to conceal the stem driver and the stem adapter.

11. The valve assembly of claim 10, wherein the bonnet is rotatable with respect to the handle.

12. A valve assembly, comprising:

a rotatable valve stem for controlling fluid flow through the valve assembly;

a stem adapter having an opening extending through opposite first and second ends and having a radial stop member positioned closer to the first end than the second end such that the opening alternatively is suitable to receive a first distance of the valve stem from the first end and a second distance of the valve stem different from the first distance from the second end, and wherein the opening can receive a third distance of the valve stem different than the first and second distances when the radial stop has flexed radially outwardly; and a handle linked to the valve stem via the stem adapter.

* * * * *